US005329207A

United States Patent [19]

Cathey et al.

[11] Patent Number: 5,329,207

[45] Date of Patent: Jul. 12, 1994

[54] FIELD EMISSION STRUCTURES PRODUCED ON MACRO-GRAIN POLYSILICON SUBSTRATES

[75] Inventors: David A. Cathey; J. Brett Rolfson; Tyler A. Lowrey; Trung T. Doan, all of Boise, Id.

[73] Assignee: Micron Technology, Inc., Boise, Id.

[21] Appl. No.: 883,629

[22] Filed: May 13, 1992

[51] Int. Cl.[5] ..... H01J 1/30

[52] U.S. Cl. ..... 315/169.1; 313/309; 445/24; 445/50

[58] Field of Search ..... 315/58, 71, 72, 169.1, 315/344, 349; 313/306, 309, 311; 445/24, 25, 50

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,812,559 | 5/1974 | Spindt et al. | 29/25.18 |
| 3,875,442 | 4/1975 | Wasa et al. | 313/193 |
| 4,196,041 | 4/1980 | Baghdadi et al. | 156/620 |
| 4,923,421 | 5/1990 | Brodie et al. | 445/24 |
| 4,943,343 | 7/1990 | Bardai et al. | 445/24 X |
| 4,997,780 | 3/1991 | Szluk et al. | 437/41 |
| 5,064,396 | 11/1991 | Spindt et al. | 445/50 |
| 5,083,958 | 1/1992 | Longo et al. | 445/24 |
| 5,186,670 | 2/1993 | Doan et al. | 445/24 |
| 5,205,770 | 4/1993 | Lowrey et al. | 445/24 |
| 5,217,401 | 6/1993 | Watanabe et al. | 313/309 X |
| 5,229,331 | 7/1993 | Doan et al. | 445/50 X |
| 5,232,549 | 8/1993 | Cathey et al. | 445/24 X |

OTHER PUBLICATIONS

S. D. Brotherton, "Poly-crystalline Silicon Thin Film Devices for Large Area Electronics", Microelectronic Engineering 15, 1991, pp. 333-340.

Madeleine Bonnel, Nichole Duhamel, Mohamed Guendouz, Lazhar Hiji, Bertand Loisel and Patrick Rualt, " Poly-Si Thin Film Transistors Fabricated with Rapid Thermal Annealed Silicon Films", Japanese Journal of Applied Physics, Nov., 1991, pp. L1924-L1926.

Satoshi Takenake, Masafumi Kunii, Hideali Oka and Hajime Kurihara, "High Mobility Poly-Si TFTs Using Solid Phase Crystallized a Si Films Deposited by Plasma Enhanced Chemical Vapor Deposition", Extended Abstracts of the 22nd 1990 Internation Conference on Solid State Device and Materials, Sendai.

Hiroshi Kanoh, Osamu Sugiura, Paul A. Breddels and Masakiyo Matsumura, "Optimization of Chemical Vapor Deposition Conditons of Amorphous-Silicon Films for Thin-Film Transistor Application", Japanese Journal of Applied Physics, Nov., 1990, pp. 2358-2364.

Thomas W. Little, Ken-ichi Takahara, Hideki Koike, Takashi Nakazawa, Ichio Yudasaka and Hiroyuki Ohshima, "Low Temperature Poly-Si TFTs Using Solid Phase Crystallization of Very Thin Films and an Electron Cyclotron Resonance Chemical Vapor Deposition Gate Insulator", Japanese Journal, Dec. 1991.

S. D. Brotherton, J. R. Ayres and N. D. Young, "Characterisation of Low Temp. Poly-Si Thin Film Transistors", Solid-State Electronics, 1991, pp. 671-697.

Fei Luo, Gerold W. Neudeck and Shengwen Luan, "Simulation of the Turn-On Transient Behavior of Amorphous-Silicon Thin-Film Transistors", Solid-State Electronics, 1991, pp. 1289-1295.

Uday Mitra, Barbara Rossi, and Babar Khan, "Mechanism of Plasma Hydrogenation of Polysilicon Thin Film Transistors", pp. 3420-3424 J. Electrochem. Soc., Nov. 1991.

*Primary Examiner*—Tony M. Argenbright
*Attorney, Agent, or Firm*—Lia M. Pappas

[57] ABSTRACT

A baseplate for a flat panel display comprising relatively thick semiconductor substrate, wherein the semiconductor substrate is a macro-grain polycrystalline substrate, which is amorphized by ion implantation or reformed by recrystallization, to obscure the grain boundaries, thereafter redundant circuitry may be fabricated thereon to further enhance product yield.

20 Claims, 7 Drawing Sheets

FIELD EMISSION STRUCTURES PRODUCED ON MACRO-GRAIN POLYSILICON SUBSTRATES

FIELD OF THE INVENTION

This invention relates to field emission devices, and more particularly to the use of macro-grain polysilicon substrates for low-cost production of field emission structures.

BACKGROUND OF THE INVENTION

Flat panel displays have become increasingly important in appliances requiring lightweight portable screens. Currently, such screens use electroluminescent or liquid crystal technology. A promising technology is the use of a matrix-addressable array of cold cathode emission devices to excite phosphor on a screen.

In field emission display (FED) technology, glass substrates with evaporated molybdenum tips have been fabricated according to the "Spindt" process which was disclosed in U.S. Pat. Nos. 3,665,241, and 3,755,704, and 3,812,559 and 5,064,396. This process has the drawback that the integrated circuit drivers are not possible on the same substrate as the tips.

A process for constructing emitter tips of silicon, typically <100> orientation, is described in U.S. Pat. application Serial No. 837,833, entitled "Method of Creating Sharp Asperities and other Features on the Surface of a Semiconductor Substrate," having the same assignee as the present application. While this approach has merit in that it allows the formation of integrated circuits which lowers the cost of the drivers, as well as the complexity of the drivers, it also has a drawback which is the relatively high cost of the substrates currently available. Through the use of a relatively thick substrate of macro-grain polycrystalline silicon according to the present invention, the best of the low-cost and integrated drivers can be realized.

Macro-grain polysilicon is relatively easy to make. Molten silicon is simply allowed to cool. The size of the grains is dependent on the rate of cooling. The faster the silicon cools, the smaller the grains. The manufacturing process is less sensitive and less time consuming than making monocrystalline wafers, and as a result, the macro-grain wafers cost less. In fact, macro-grain polysilicon is even cheaper than using a glass substrate. This is because high temperature glass is the preferred glass for the fabrication of flat panel displays, and such glass is more costly than macro-grain polysilicon.

A great deal of research has been conducted in the area of large grain amorphous silicon substrates which are comparatively thin (i.e. less than 1 micron) for use in liquid crystal displays (LCD's). The amorphous silicon does not have a definite arrangement of the silicon atoms. A representative grain size would be in the range of 50 nm, although grain sizes used in such research do vary significantly.

In contrast, the present invention relates to macro-grain polycrystalline substrates which are relatively thick (i.e. greater than 300 microns). In such a case, the atoms are arranged in unit cells, but the unit cells are not in a regular arrangement with each other, and the cells have very large grain boundaries. Macro-grain being defined as a substrate in which less than 1% of the crystal grains are smaller than 0.5 mm.

The grain boundaries are essentially defects in the substrate, and the present invention provides a means for overcoming these substrate defects, and effectively using the substrate in a flat panel display unit. The grain boundaries represent a change in the orientation of the crystalline structure of the substrate. First quality silicon wafers have a single crystal (or monocrystalline) orientation, and are the desired substrate for integrated circuit fabrication.

One of the problems which results from the presence of grain boundaries is the unpredictability in etching steps. When the etching material hits a grain boundary, the material is hindered, and the result of the etch step is a often a defective device. On a wafer containing many integrated circuit devices, the loss of a single chip may not be a significant commercial loss. However, in the fabrication of flat panel display devices, a single defect can result in the loss of the whole wafer, since the wafer as a whole is commonly employed in the display unit. A device defect appears as a black spot or line through the screen, and thus makes the entire unit unmarketable.

One advantage of macro-grain polysilicon substrates is their availability in relatively large sizes at comparatively low costs. A further advantage is that macro-grain substrates are adaptable to high temperature processing. A still further advantage of macro-grain polysilicon substrates is that such substrates have a thermal co-efficient of expansion which matches the co-efficient of expansion of the active silicon devices which are fabricated thereon.

Another further advantage of the present invention is that the use of redundant circuitry on a macro-grain substrate will tend to improve the yield because such redundant circuitry compensates for the possibility that a device is inadvertently placed at a major grain boundary.

SUMMARY OF THE INVENTION

A baseplate for use in a flat panel display can be formed from a relatively thick semiconductor substrate, wherein the semiconductor substrate comprises a macro-grain polycrystalline material, and has redundant circuitry fabricated thereon to further enhance product yield.

The method of fabricating emitter tips on a macro-grain polycrystalline substrate comprises reforming the substrate through recrystallization or amorphizing the substrate by ion implantation, thereby damaging the substrate to such a degree that the grain boundaries become obscured, patterning the substrate through a mask step, and etching the substrate to define the emitter tips, after which the emitter tips can be sharpened if desired.

A baseplate fabricated on a relatively thick macro-grain substrate and having redundant circuitry thereon is possible, once the macro-grain polysilicon substrate has been coalesced through recrystallization or amorphized through ion implantation.

BRIEF DESCRIPTION OF THE DRAWINGS

The present invention will be better understood from reading the following description of nonlimitative embodiments, with reference to the attached drawings, wherein:

FIG. 3B' is a cross-sectional schematic drawing of the macro-grain polycrystalline substrate of FIG. 3B, after an etching step to expose the emitter tips as seen in FIG. 1;

It should be emphasized that the drawings of the instant application are not to scale, but are merely schematic representations, and are not intended to portray the specific parameters or the structural details of a flat panel display which are well known in the art.

DETAILED DESCRIPTION OF THE INVENTION

The macro-grain polycrystalline substrate of the present invention is described herein with respect to field emitter displays, but one having ordinary skill in the art will realize that it is equally applicable to any other flat panel display which uses a substrate on which is formed an addressable array for its operation, for example, active matrix liquid crystal displays, reflective liquid crystal displays, electroluminescent displays, and etc., or any other display in which portions of the substrate are removed thereby defining the devices which remain and to which a backplate is adhered for physical support.

Figure 1:
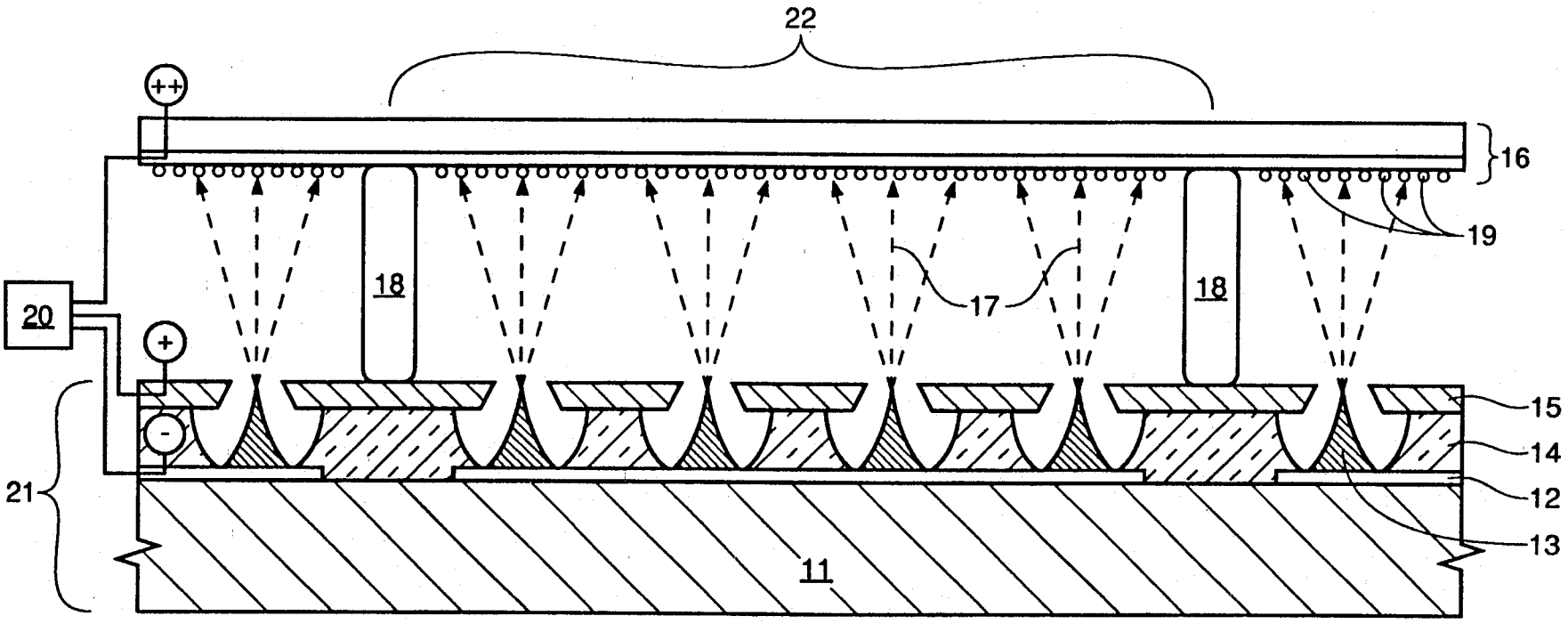
FIG. 1 is a cross-sectional schematic drawing of a pixel of a flat panel display fabricated on the macro-grain polycrystalline substrate of the present invention.

Referring to FIG. 1, a field emission display employing a pixel 22 is depicted. In the preferred embodiment, a relatively thick (i.e. greater than 300 microns) macro-grain polycrystalline silicon layer serves as a substrate 11 onto which a conductive material layer 12, such as doped polycrystalline silicon has been deposited. At a field emission site location, a conical micro-cathode 13 has been constructed on top of the substrate 11. Surrounding the micro-cathode 13, is a low potential anode gate structure 15. When a voltage differential, through source 20, is applied between the cathode 13 and the gate 15, a stream of electrons 17 is emitted toward a phosphor coated screen 16. Screen 16 is an anode. The electron emission tip 13 is integral with the macro-grain polycrystalline semiconductor substrate 11, and serves as a cathode conductor. Gate 15 serves as a low potential anode or grid structure for its respective cathode 13. A dielectric insulating layer 14 is deposited on the conductive cathode layer 12. The insulator 14 also has an opening at the field emission site location.

Disposed between said faceplate 16 and said baseplate 21 are located spacer support structures 18 which function to support the atmospheric pressure which exists on the electrode faceplate 16 as a result of the vacuum which is created between the baseplate 21 and faceplate 16 for the proper functioning of the emitter tips 13.

The baseplate 21 of the invention comprises a matrix addressable array of cold cathode emission structures 13, the substrate 11 on which the emission structures 13 are created, the conductive material layer 12, the insulating layer 14, and the anode grid 15.

Figure 2A:
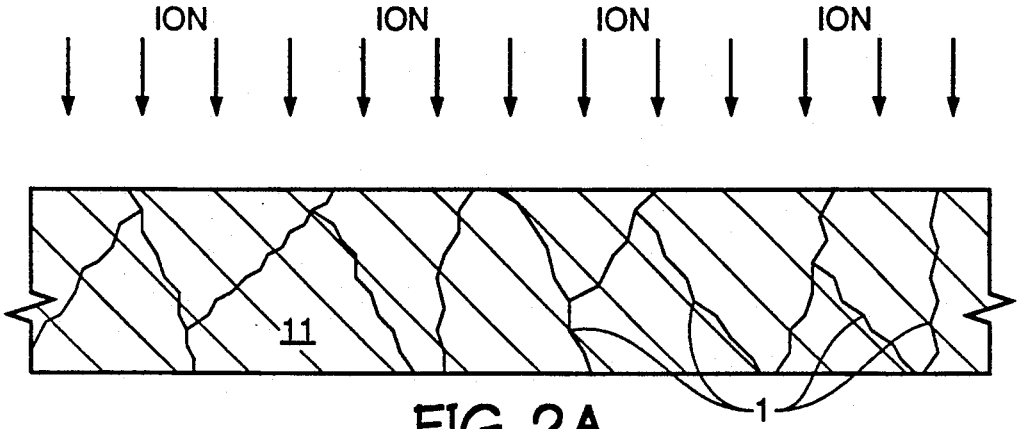
FIG. 2A is a cross-sectional schematic drawing of the macro-grain polycrystalline substrate of the present invention used in the fabrication of the flat panel display of FIG. 1.

In order to fabricate an electrode baseplate 21 containing the cathode array 13 on a macro-grain polycrystalline substrate 11, the grain boundaries 1 in the substrate 11 should be substantially minimized or eliminated. The grain boundaries 1 can form various shapes in the substrate ranging from oblong to rectangular. In the present invention, the macro-grain polycrystalline substrate 11 is amorphized to obscure the grain boundaries 1. Ion implantation or bombardment, using fluorine ions, for example, is the preferred method by which to amorphize or damage the substrate 11, as depicted in FIG. 2A.

Figure 2B:
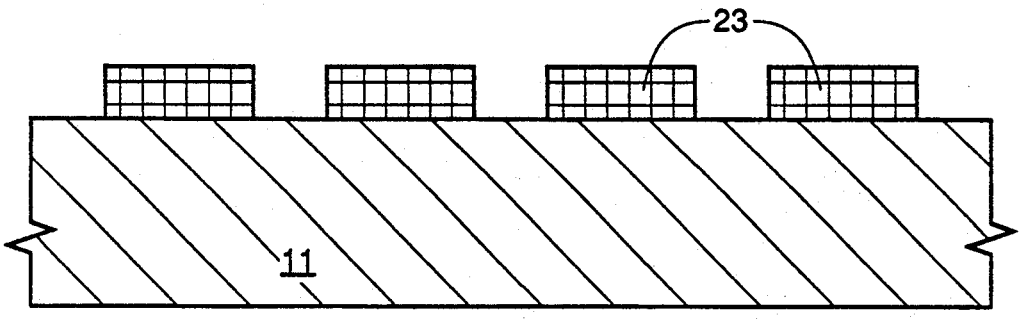
FIG. 2B is a cross-sectional schematic drawing of the macro-grain polycrystalline substrate of FIG. 2A after the substrate has been amorphized and patterned.

The substrate 11 is then masked through any suitable patterning technique which is known in the art, as seen in FIG. 2B. The pattern 23 will define the sites of the emitter tips 13. Similarly, the redundant integrated circuitry of FIG. 6 can also be fabricated, using methods presently known in the semiconductor art, on the same substrate 11 as the emitter tips 13 which the active circuitry will operate, thereby minimizing external electronics and interfaces. The opportunity to fabricate transistors on the same substrate 11 as the cathodes 13 represents one of the advantages of using the macro-grain polycrystalline substrate 11 according to the process of the present invention. Of course, fabricating the circuitry on this same substrate 11 as the emitter tips 13 is an option, and not a requirement.

Figure 2C:
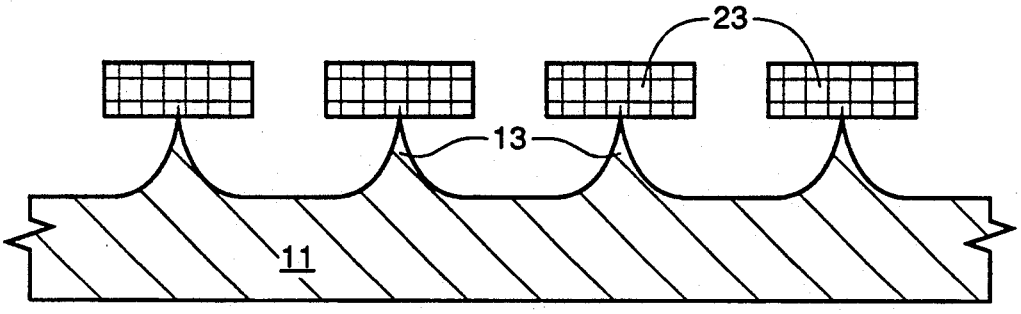
FIG. 2C is a cross-sectional schematic drawing of the macro-grain polycrystalline substrate of FIG. 2B after the substrate has been etched to define the emitter tips as seen in FIG. 1.

FIG. 2C further illustrates the fabrication of the emitter tips 13 on the macro-grain substrate 11. The emitter tips 13 are created through an etching step. As previously mentioned, it is the etching steps which are critical when fabricating structures on substrates 11 with grain boundaries 1. If the grain boundaries 1 have been sufficiently damaged through the ion implant process, a reasonable yield can be expected.

Figure 2D:
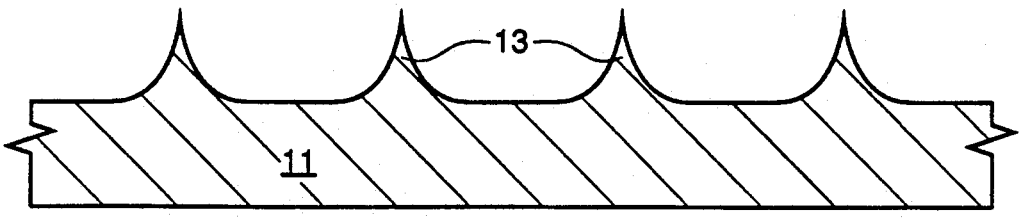
FIG. 2D is a cross-sectional schematic drawing of the macro-grain polycrystalline substrate having emitter tips of FIG. 2C after the patterning has been removed.

Once the etching step has been completed, the mask 21 can be removed thereby exposing the emitter tips 13, as seen in FIG. 2D. At this point, the other structures of the flat panel display (e.g. grid 15, insulating layers 14, etc.) can be fabricated in the usual manner. See for example: U.S. Pat. No 3,875,442, entitled "Display Panel," in which Wasa et. al. disclose a display panel; Spindt, et. al. discuss field emission cathode structures in U.S. Pat. Nos. 3,665,241, and 3,755,704, and 3,812,559; and Brodie, et al. discuss a "Method for Providing Polyimide Spacers in a Field Emission Panel Display" in U.S. Pat. No. 4,923,421.

The preferred embodiment is fabricated by methods disclosed in: U.S. Patent application Serial No. 837,833, entitled "Method of Creating Sharp Asperities and other Features on the Surface of a Semiconductor Substrate;" U.S. Pat. No. 5,205,770 entitled, "Method to Form High Aspect ratio Supports (Spacers) for Field Emission Display Using Micro-Saw Technology;" U.S. Patent application Serial No. 5,186,670 entitled, "Method to Form Self-Aligned Gate Structures and Focus Rings;" and U.S. Pat. No. 5,129,331, entitled, "Method to Form Self-Aligned Gate Structures Around Cold Cathode Emitter Tips Using Chemical Mechanical Polishing Technology" all having the same assignee as the present application.

Alternative methods to overcome the problems inherent with the grain boundaries 1 of the macro-grain substrate 11 are depicted in FIGS. 3A–5.

Figure 3A:
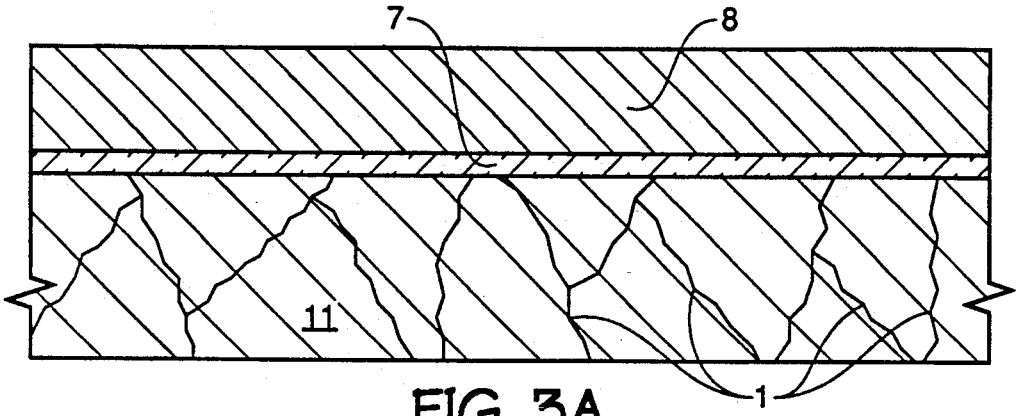
FIG. 3A is a cross-sectional schematic drawing of the macro-grain polycrystalline substrate of the present invention used in the flat panel display of FIG. 1, the substrate having an insulating layer and an amorphous silicon or polysilicon layer deposited thereon.

The first group of alternatives, as illustrated in FIG. 3A, involves fabrication processes in which an insulating layer 7 is deposited or grown on the macro-grain polycrystalline substrate 11. The insulating material 7 can be any suitable material, but is preferably silicon dioxide ($SiO_2$). Superjacent the insulating layer 7, a layer 8 of amorphous silicon or polysilicon can be deposited.

Figure 3B:
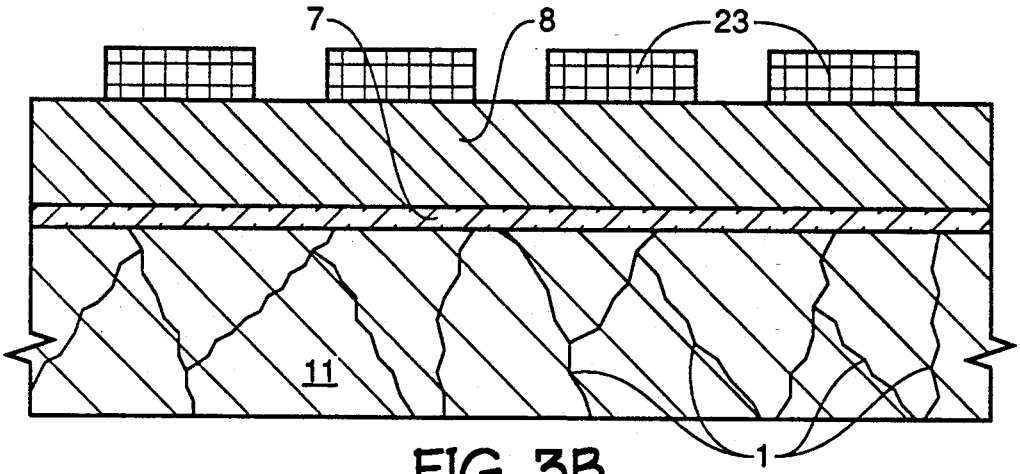
FIG. 3B is a cross-sectional schematic drawing of the macro-grain polycrystalline substrate of FIG. 3A, after a patterning step to define the sites of the emitter tips as seen in FIG. 1.
Figure 3B:
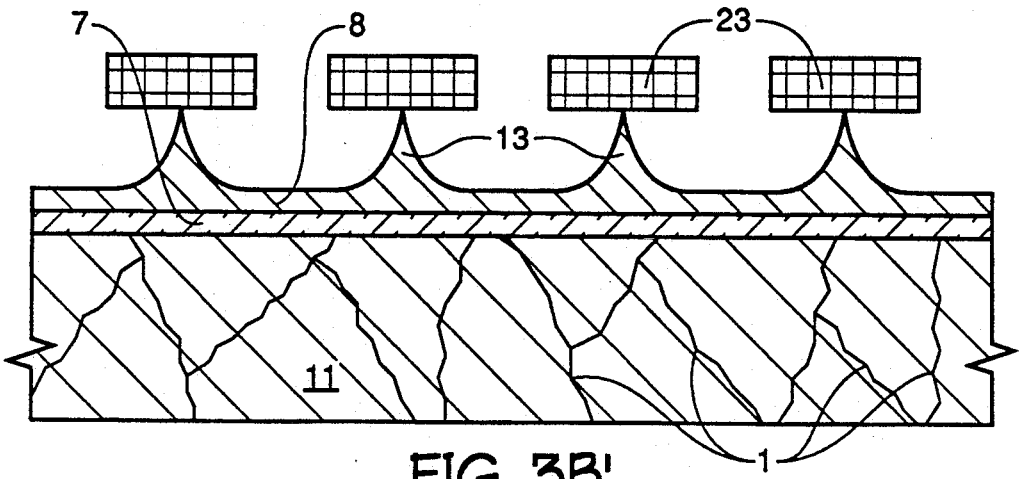
Figure 6:
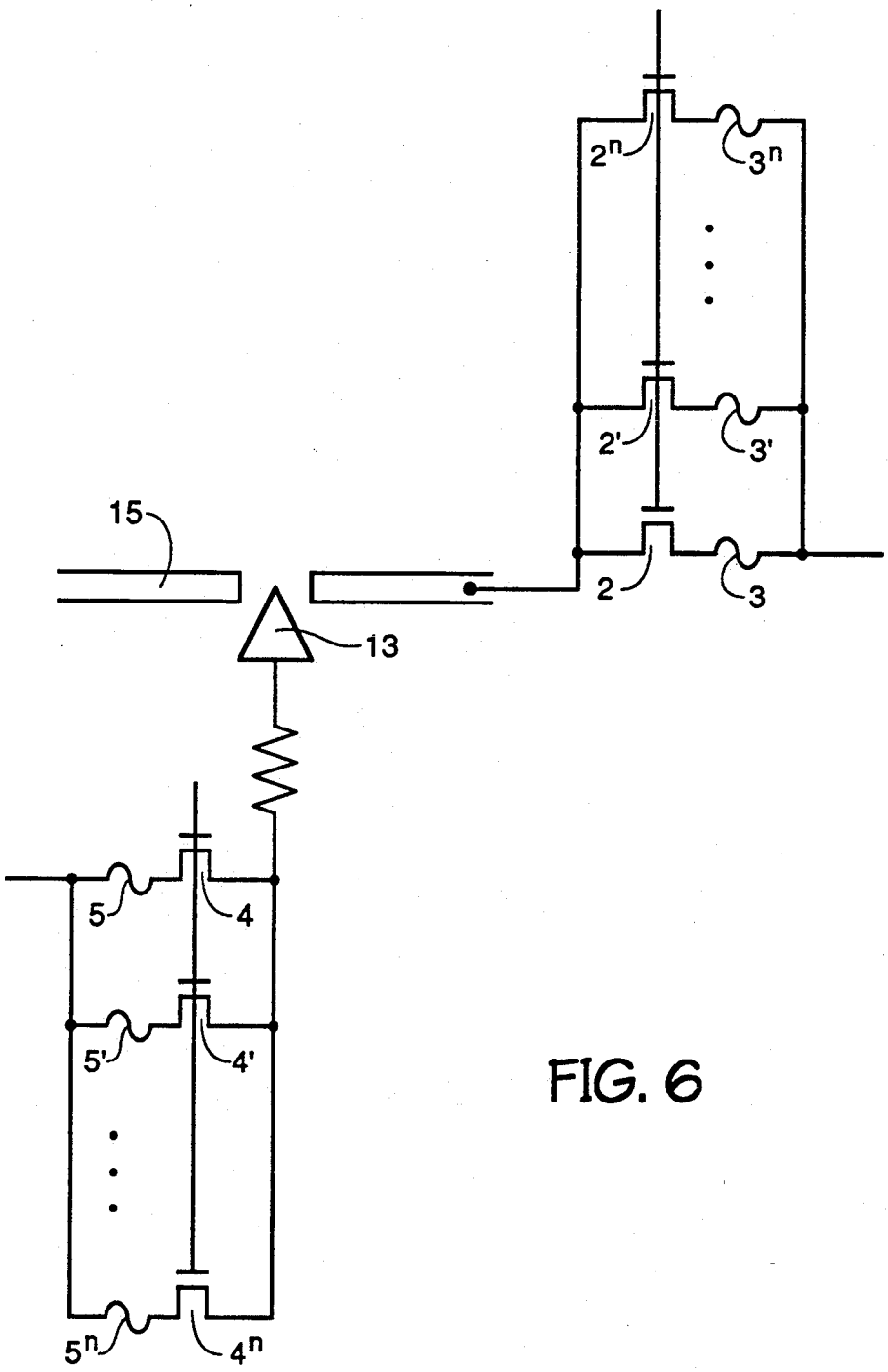
FIG. 6 is a schematic drawing of the anode gate and the emitter tip and which is fabricated on the macro-grain polycrystalline substrate and the redundant circuitry which is used to activate the tip.

At this point, one option, as illustrated in FIG. 3B, is to use the macro-grain substrate 11 to form patterned silicon. In this case the emitter tips 13 and thin film transistors (2 and 4 as seen in FIG. 6) can be fabricated through an etching step, as shown in FIG. 3B'. In such a case, the grain boundaries 1 can be hydrogenated to improve mobility of the electrons within the substrate 11.

Figure 3C:
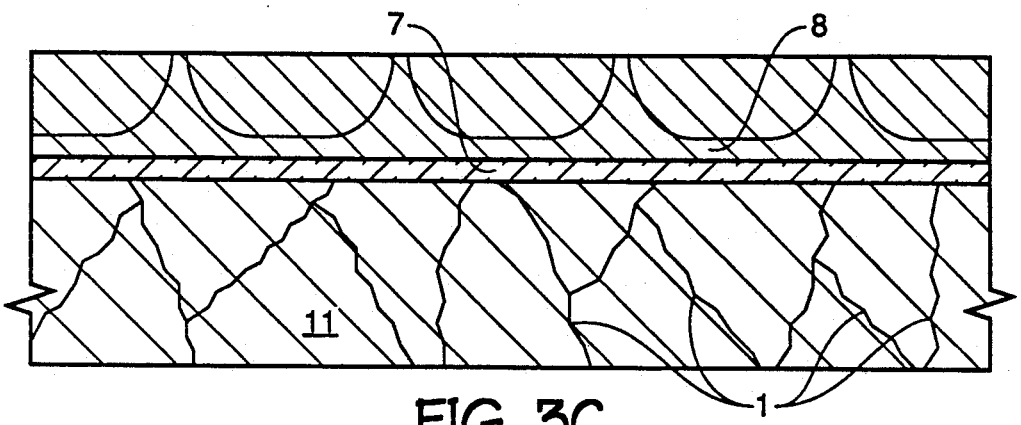
FIG. 3C is a cross-sectional schematic drawing of the macro-grain polycrystalline substrate of FIG. 3A, which has been diffused to form P/N junctions at the sites of the emitter tips as seen in FIG. 1.

Another option, as depicted in FIG. 3C, is to employ silicon 8 on insulator 7 (SOI) technology and fabricate the emitter tips 13 and thin film transistors (2 and 4, as shown in FIG. 6) using diffuse P/N junctions, which P/N junctions can be patterned by methods known in the art, or the P/N junctions can be self-aligned by methods also known in the art. In such cases, the grain boundaries 1 can be hydrogenated to improve mobility of the electrons within the substrate 11.

Figure 3D:
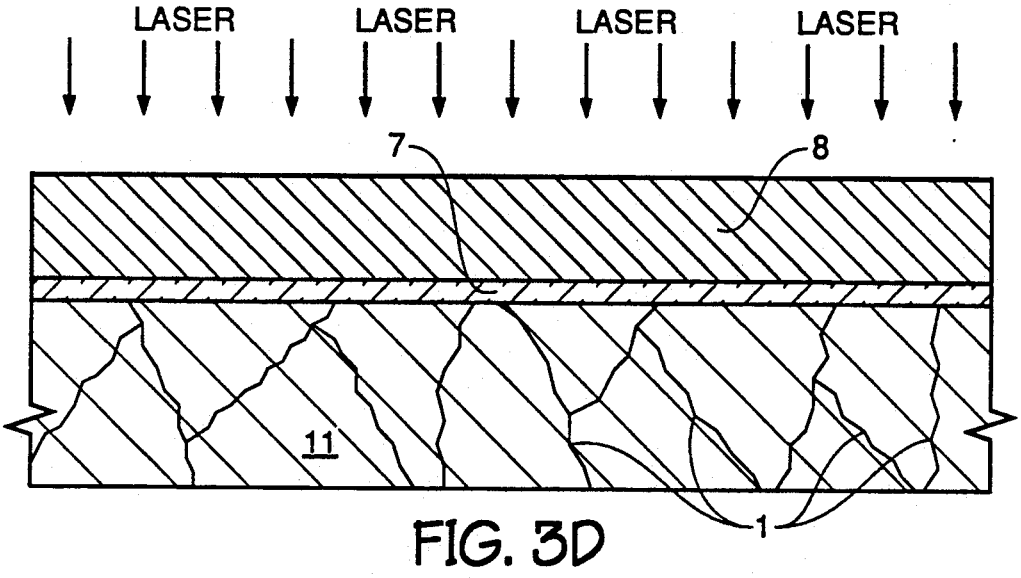
FIG. 3D is a cross-sectional schematic drawing of the macro-grain polycrystalline substrate of FIG. 3A further illustrating recrystallization with a high energy beam.
Figure 3E:
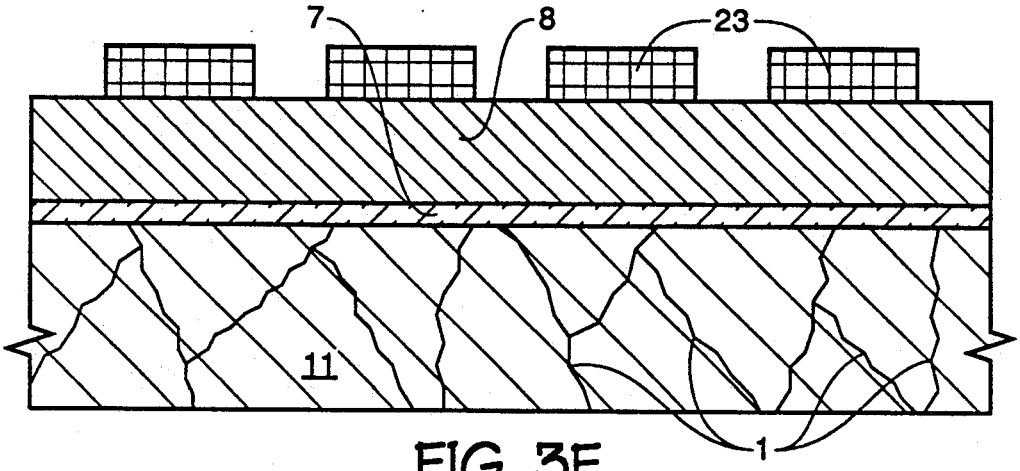
FIG. 3E is a cross-sectional schematic drawing of the macro-grain polycrystalline substrate of FIG. 3D, after a patterning step to define the sites of the emitter tips as seen in FIG. 1.

As shown in FIG. 3D, another option is to recrystallize or reform the amorphous or polysilicon layer 8 to form single crystal silicon. After the recrystallization step, the silicon layer is patterned 23, as illustrated in FIG. 3E. An etching step is then performed, thereby defining the emitter tips 13.

Figure 3F:
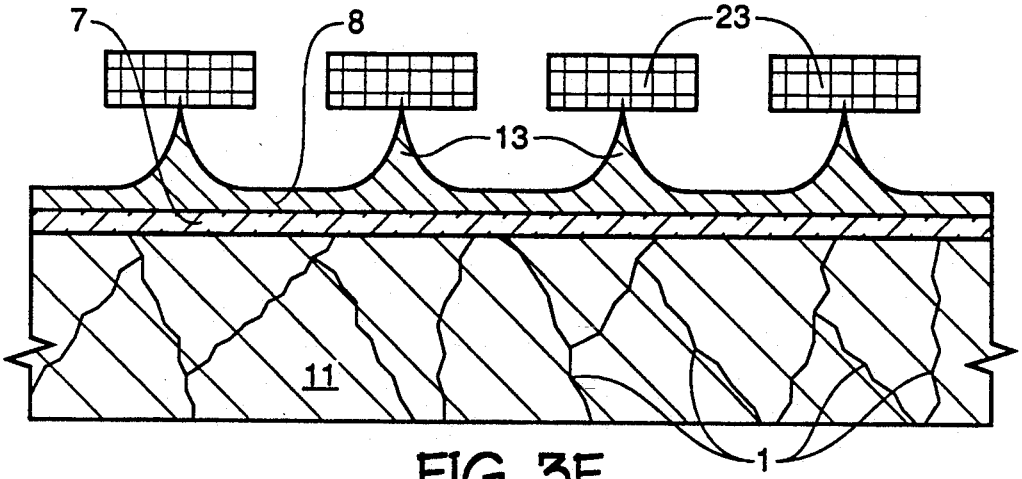
FIG. 3F is a cross-sectional schematic drawing of the macro-grain polycrystalline substrate of FIG. 3D, which has been diffused to form P/N junctions etched at the sites of the emitter tips as seen in FIG. 1.

A further option is silicon on insulator (SOI) technology which can also be used after a recrystallization step, as seen in FIG. 3F. The emitter tips 13 and thin film transistors (2 and 4, as shown in FIG. 6) can be fabricated using diffuse P/N junctions, which P/N junctions can be patterned by methods known in the art or the P/N junctions can be selfaligned by methods also well known in the art.

Figure 4A:
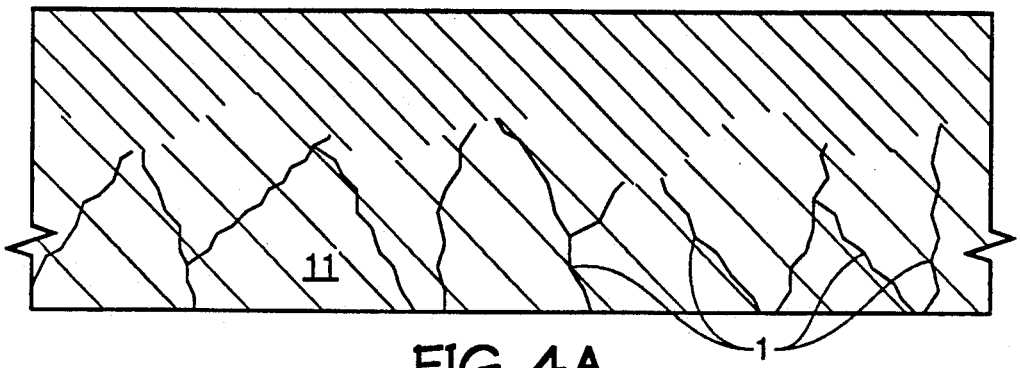
FIG. 4A is a cross-sectional schematic drawing of the macro-grain polycrystalline substrate of the present invention used in the fabrication of the flat panel display of FIG. 1, after the substrate has been recrystallized.
Figure 4B:
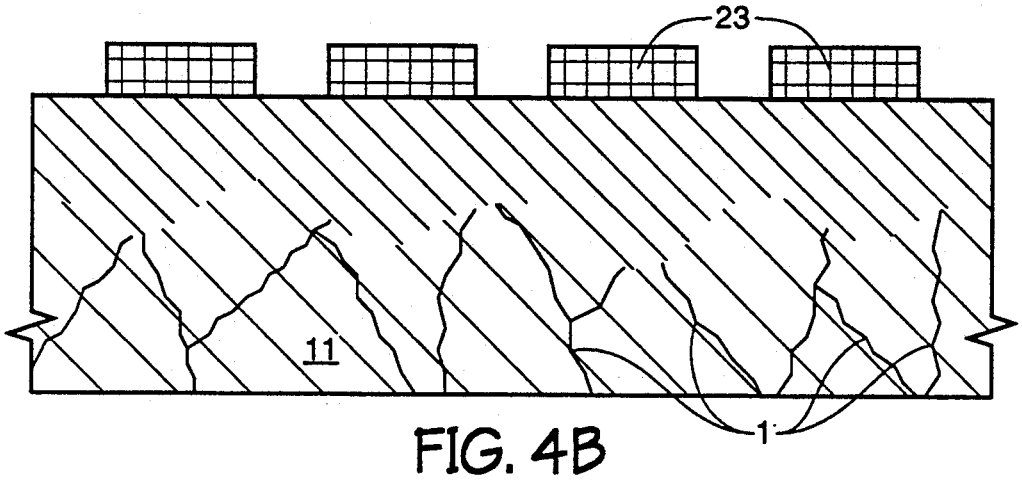
FIG. 4B is a cross-sectional schematic drawing of the macro-grain polycrystalline substrate of FIG. 4A, which has been patterned to define the sites of emitter tips.

Another alternative, as illustrated in FIG. 4A, is to coalesce or reform the macro-grain substrate 11 by recrystallization to form single crystal silicon and simply use the macro-grain polysilicon 11 directly (i.e. without the insulator layer 7 and amorphous or polysilicon layer 8) for semiconductor manufacture, and manufacture of field emission devices 13, through patterning 23, as illustrated in FIG. 4B, and etching.

Recrystallization in the above-mentioned cases, can be accomplished by seeding the substrate 11 with a crystal, and then using an intense light source or laser to scan and heat the substrate, thereby growing a substrate having a single crystal orientation.

Significant recent work has involved the use of laser beam recrystallization to convert polycrystalline or amorphous silicon regions to a monocrystalline form by initiating a melt of the polycrystalline silicon or amorphous silicon at a seed point on a monocrystalline substrate, and then extending that seed onto a dielectric region.

The fundamentals of this concept are described in U.S. Pat. No. 4,323,417. The effects of varying the shape of the initial polycrystalline or amorphous silicon structures and the beams are considered in U.S. Pat. No. 4,330,363, in a context where no seeding is used during the conversion to monocrystalline form. Further refinements in recrystallization from monocrystalline silicon seed regions are described in U.S. Pat. Nos. 4,592,799 and 4,599,133. The former relates to the orientation of seeding locations with respect to scan direction of the laser beam as well as the shape of the beam, a central teaching being that the direction of movement of a beam be transverse to the elongated direction of the beam and the seed region pattern. The latter noted patent extends these concepts to multiple layers of silicon, individually isolated by the presence of dielectric layers in non-seed regions. See also, U.S. Pat. No. 4,997,780 which discloses a method of making CMOS integrated devices in seeded islands.

Figure 5:
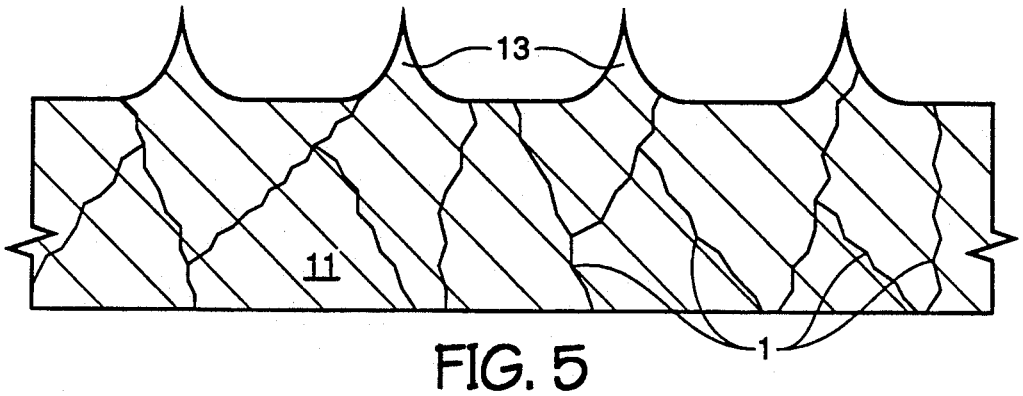
FIG. 5 is a cross-sectional schematic drawing of the macro-grain polycrystalline substrate of the present invention used in the fabrication of the flat panel display of FIG. 1, with the emitter tips fabricated directly thereon.

A further alternative, as illustrated in FIG. 5, is simply to use the macro-grain polycrystalline substrate 11 as it is, and to produce transistors (such as 2 and 4 in FIG. 6) directly thereon, which transistors 2 and 4 can be isolated through P/N junctions, which P/N junctions can be patterned by methods known in the art or the P/N junctions can be selfaligned by methods also well known in the art. In such cases, the grain boundaries 1 can be hydrogenated to improve mobility of the electrons within the substrate 11.

FIG. 6 illustrates the redundant integrated control and active drive circuitry which can be formed on the macro-grain substrate 11 to operate the emitter tips 13 and anode grid 15. The integrated circuitry is preferably fabricated in parallel, and preferably involves a simple duplication of the necessary transistors 2 and 4, capacitors etc. which are used to activate the desired emitter tips 13 and associated grid 15. In actual practice, the degree of redundancy illustrated by FIG. 6 will not be employed.

In the preferred method, the anode grid 15 can be placed in the ON position at substantially all times in which the display is in use (and therefore will not necessitate the redundancy at the grid level 15 which is illustrated in FIG. 6), and the redundant circuitry will be used to activate the tips 13 through row and column addressing.

Another alternative would be to have the tips turned ON at substantially all times when the display is in use, and to provide redundant circuitry only for the gate 15. Such an alternative is not very practical because it is more difficult to fabricate circuitry on the grid layer 15.

One of ordinary skill in the art will realize that it is possible to replicate the control and drive circuitry in greater multiples if desired for either the grid 15 or the tips 13 (i.e. transistors $2^n$ and $4^n$ of FIG. 6). If the circuit designer chooses to implement greater multiples of transistors, capacitors, resistors, etc., such devices can be placed at angles other than 180 degrees from each other, to further minimize the possibility that a device will reside on a grain boundary 1. The result being to further insure an enhanced yield, and thereby minimize the chance of nonfunctional pixels 22.

Any of the methods known in the art can be used to break the fuses 3, 3' etc or 5, 5' etc in the excess circuitry. Some examples of fuse breaking include: application of laser energy, high internal current, or an automatic fuse blowing mechanism. See, for example, U.S Pat. No. 5,038,368 entitled, "Redundancy Control Circuit Employed with Various Digital Logic Systems Including Shift Registers."

Because of interconnection problems, silicon substrates with NMOS or CMOS drive circuitry fabricated on the same substrate as the emitter tips 13 represent a tremendous advantage. Because silicon wafers can be manufactured with enormous size grains, it is possible to produce redundant fuses 3 and selectable MOS drive circuitry such that in the instances when transistors 2 or 4 are fabricated such that a grain boundary 1 crosses a P/N junction (a potential leakage defect), the transistor 2 or 4 can be fused out of the circuit (or otherwise deselected) or placed in a series with more than one access device at different locations with the gates of each connected in parallel.

All of the U.S. patents and patent applications cited herein are hereby incorporated by reference herein as if set forth in their entirety.

While the particular macro-grain polycrystalline substrate for use in flat panel displays as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims. For example, although the preferred embodiment is described with reference to field emitter displays, one with ordinary skill in the art would understand that the present invention could be applied to other flat panel technologies requiring transistors or other on-board circuitry as may be required to operate the display, not only cold cathode emitters. Further, there is a wide latitude with regard to the structural elements which can be used in the baseplate of a display.

We claim:

1. A baseplate for use in a flat panel display, said baseplate comprising:

a semiconductor substrate said substrate being a relatively thick macro-grain polycrystalline substrate, said substrate being a first side and a second side;

a conductive layer being disposed superjacent said first side of said substrate;

at least one insulating layer being disposed superjacent said conductive layer, said insulating layer having a plurality of spaces disposed therein;

an anode grid being disposed superjacent said insulating layer, said anode grip having a plurality of cavities disposed therein, said cavities having a shape, said anode grid being disposed on said insulating layer such that said spaces of said insulating layer are contiguous with said cavities in said anode grid;

a plurality of cathode tips being disposed superjacent said conductive layer, said cathode tips extending through said spaces in said insulating layer to a point in said cavities of said anode grid such that a voltage differential between sand anode grid and one of said cathode tips will cause electrons to be emitted from said cathode tip; and a power source, said power source providing said voltage differential between said anode grip and said cathode tips.

2. The baseplate according to claim 1, wherein less than one percent of said macro-grains are smaller than approximately 0.5 mm in diameter.

3. The baseplate according to claim 2, wherein said macrograin substrate has a thickness greater than 300 microns.

4. The baseplate according to claim 1, wherein redundant address circuits are disposed superjacent said conductive layer, said redundant circuits selectively activating said cathode tips.

5. The baseplate according to claim 4, wherein said redundant circuits are comprised of at least two transistors, said transistors being at least one of CMOS and NMOS.

6. A process for forming a baseplate having a macrograin polysilicon substrate for use in a flat panel display, said baseplate fabricated from the following steps comprising:

reforming macro-grain substrate, said substrate having grain boundaries, said boundaries being approximately 0.5 mm apart, whereby said reforming of said macro-grain substrate obscures said grain boundaries;

patterning said substrate, thereby defining at least one emitter;

etching said substrate, thereby exposing said emitter, depositing an insulating layer superjacent said substrate and at a distance around said emitter; and depositing a conductive layer in a pattern superjacent said insulating layer, said conductive layer functioning as an anode grid.

7. The process according to claim 6, further comprising the step of:

forming redundant circuits on said substrate, each of said circuits having at least two transistors, whereby at least one of said emitter and said anode grid is controlled by a set of said at least two transistors, said at least two transistors being connected in parallel.

8. The process according to claim 7, wherein said at least two transistors are at least one of CMOS and NMOS.

9. The process according to claim 8, wherein said macrograin substrate has a thickness greater than 300 microns.

10. The process according to claim 9, wherein said reforming step is accomplished through ion implantation, said ion implantation using fluorine ions.

11. The process according to claim 9, wherein said reforming step is accomplished through recrystallization.

12. A process for forming a baseplate having a macrograin polysilicon substrate for use in a flat panel display, said baseplate fabricated from the following steps comprising:

applying an insulator material superjacent said macro-grain substrate;

applying a silicon layer superjacent said insulator material;

patterning said silicon layer thereby defining a site of at least one emitter;

etching said substrate, thereby forming said emitter at said site;

depositing an insulating layer superjacent said substrate and at a periphery of said emitter; and depositing a conductive layer in a pattern superjacent said insulating layer, said conductive layer functioning as an anode grid.

13. The process according to claim 12, further comprising the step of:

forming redundant circuits on said substrate, each of said circuits having at least two transistors, whereby at least one of said emitter and said anode grid is controlled by a set of said at least two transistors, said at least two transistors being connected in parallel, thereby compensating for any leakage in one of said at least two transistors.

14. The process according to claim 13, wherein said at least two transistors are at least one of CMOS and NMOS.

15. The process according to claim 14, wherein said macrograin substrate has a thickness greater than 300 microns.

16. The process according to claim 15, further comprising the step of:

deselecting one of said at least two transistors.

17. The process according to claim 16, wherein said deselecting of said one of said at least two transistors is accomplished with a high energy beam.

18. The process according to claim 17, wherein said silicon layer comprises at least one of amorphous silicon and polysilicon.

19. The process according to claim 18, further comprising the step of:

creating diffuse P/N junctions in said insulator material prior to said patterning step.

20. The process according to claim 19, further comprising the step of recrystallizing said silicon layer prior to said patterning step.

* * * * *